United States Patent [19]

Worsnop

[11] Patent Number: 4,882,798

[45] Date of Patent: Nov. 28, 1989

[54] SLING FOR LIFTING A DISABLED PERSON

[76] Inventor: Jack Worsnop, 9 North View Barney NR21 0NE, Fakenham, Norfolk, England

[21] Appl. No.: 219,724

[22] Filed: Jul. 15, 1988

[51] Int. Cl.[4] ..... A61G 1/00

[52] U.S. Cl. ..... 5/89; 5/81 R; 294/67.31; 294/140

[58] Field of Search ..... 5/81 R, 81 B, 89, 83, 5/86; 294/74, 67.3, 140

[56] References Cited

U.S. PATENT DOCUMENTS

| | | | |
|---|---|---|---|
| 1,507,110 | 9/1924 | Duncan | 16/225 X |
| 1,876,832 | 9/1932 | Bancroft | 5/89 |
| 2,125,546 | 8/1938 | Corr | 5/89 X |
| 2,975,434 | 3/1961 | Butler et al. | 5/89 X |
| 3,469,269 | 9/1969 | Brown | 5/89 X |
| 3,608,104 | 9/1971 | Van Gerven | 5/83 |
| 3,694,829 | 10/1972 | Bakker | 5/89 X |
| 4,138,750 | 2/1979 | Michalowski | 5/86 X |
| 4,221,011 | 9/1980 | Flinchbaugh | 5/89 |
| 4,704,749 | 11/1987 | Aubert | 5/81 R X |

*Primary Examiner*—Gary L. Smith
*Assistant Examiner*—Michael J. Milano
*Attorney, Agent, or Firm*—Neal J. Mosley

[57] ABSTRACT

The invention relates to a sling for lifting a disabled person and in particular to a sling for supporting the thighs of a disabled person. The sling comprises two rigid members substantially identical to one another; each rigid member having a cross section in a first longitudinal direction which is substantially constant and each rigid member including an inner surface which, in use, is closest to the disabled person, which inner surface includes a curvate portion which is curved about at least one axis parallel to said longitudinal direction, said each curvate portion defining a hollow into which, in use, the thigh of a disabled person may be placed; the rigid members being joined by a connector which allows pivotal movement of the rigid members relative to each other about an axis substantially parallel to the axis about which the curvate portion of the inner surface is curved; the sling also including means for attaching the sling to a lifting device in the region of the connector.

20 Claims, 3 Drawing Sheets

SLING FOR LIFTING A DISABLED PERSON

FIELD OF THE INVENTION

The invention relates to a sling for lifting a disabled person and in particular to a sling for supporting the thighs of a disable person.

In many conventional devices for lifting and moving a disabled person, the disabled person is transported in a sitting position. This is often because they are being moved in and out of wheelchairs.

The apparatus required for lifting a disabled person comprises a lifting device of some sort to which is attached a sling which supports the disabled person's body. Many different types of lifting devices have been developed and the term in the specification shall be taken to include all types of lifting device including devices for lifting and moving a disabled person into and out of a vehicle, into and out of a bath or merely from a bed to a wheelchair. The sling and lifting device have co-operating members by which the sling can be detachably fastened to the lifting device to suspend the disabled person in the sling from part of the lifting device. The means of attachment of a sling to a lifting device are known and will not be described in detail.

In some cases a disabled person needs only to be supported by his thighs if he is only disabled in the lower part of his body but in most cases either an auxiliary sling must be provided to support the back of the disabled person or the sling must integrally provide supports both for the thighs and for the back.

The following specification is concerned with a sling for supporting the thighs of a disabled person.

REVIEW OF THE PRIOR ART

A typical sling of conventional form for providing support to the thighs or lower hips comprises an elongate flexible strong strip which forms a type of flexible seat on which a disabled person rests his lower body. In use, the flexible strip has to lie beneath the thighs or lower hips of the disabled person's body with an end protruding from each opposite side of the disabled person's body. Each end is then coupled together for attachment to means for coupling the sling to a lifting device. A major problem arises in trying to move the strip into the in use position. The strip has to be passed from one side of the disabled person's body beneath their lower hips or thighs, to the opposite side of the disabled person's body. This maneuvering can be extremely difficult especially since most disabled people cannot offer much help in this movement.

This can cause major problems in many different areas, especially in baths. At present, when using a sling of conventional form, a patient has to be moved to a bath and sat on a seat within the bath. This is because if the disabled person was placed directly into the bath onto the bath floor it would be almost impossible to replace the strip beneath their thighs or lower hips in order to move the disabled person out of the bath. There is, therefore, a great need for an improved form of sling for supporting the thighs of a disabled person.

SUMMARY OF THE INVENTION

According to the invention there is provided a sling for lifting the thighs of a disabled person which comprises two rigid members substantially identical to one another; each rigid member having a cross section in a first longitudinal direction which is substantially constant and each rigid member including an inner surface which, in use, is closest to the disabled person, which inner surface includes an curvate portion which is curved about at least one axis parallel to said longitudinal direction, said each curvate portion defining a hollow into which, in use, the thigh of a disabled person may be placed; the rigid members being joined by connecting means which allows pivotal movement of the rigid members relative to each other about an axis substantially parallel to the axis about which the curvate portion of the inner surface is curved; the sling also including means for attaching the sling to a lifting device in the region of the connecting means.

The term rigid is taken to mean rigid enough to be pushable under the leg of a disabled person. The sling is used by inserting the end of a rigid member remote from the connecting means under the leg of a disabled person and then lifting the sling by the attachment means such that the action of the weight of the patient on the rigid members, combined with the force applied on the connecting means allows the curvate portion to grip the thighs of the disabled person to lift them.

The sling may be arranged in one of two different ways. The first is where the sling is arranged to be used such that the connecting means and attachment means sit between the legs of the disabled person. Such a sling is used by pushing the edge of a first rigid member remote from the connecting means under the inside of a first leg and then pushing the end of the second rigid member remote from the connecting means under the inside of the second leg of the disabled person. The connecting means then lie between the legs of the disabled person and the inner surface of the rigid members lies facing generally upwards. At this point the leg does not necessarily lie within the arcuate portion of the inner surface. As force is applied to lift the disabled person the weight of the disabled person applies weight on the rigid members and tends to press the legs apart and so rotate the rigid members relatively about the connecting means such that the curvate surface grips the thighs of the disabled person. This gives a very safe hold of the thighs of the disabled person. The only problem with such a sling is that it would be most awkward for a disabled woman wearing a skirt.

Thus, in the second embodiment of the invention the sling can be used to lift a disabled woman wearing a skirt. In this case the rigid members are arranged such that in use the inner surface faces generally downwards. In this case the curvate surface is fitted under the outside edge of each leg with the rigid member passing around and over the leg to the central area between the legs but over the body. At this point when the disabled person is lifted force is applied on the connecting means which tends to rotate the rigid members with respect to each other such that the curvate surfaces tend to rotate inwards to grip the thighs even more.

Thus, in both embodiments of the invention a sling is produced which does not have to be maneuvering under the whole body of the disabled person but has rigid members each of which has to be slid under a leg of the disabled person. Clearly this is a simple operation and is very quick to use. Moreover, this obviates the need for a seat within a bath and in some cases a disabled person can attach themselves to a sling without the need for helpers.

Clearly the connecting means connects the edges of the rigid members together remote from the curvate edges of the rigid members. This connecting means may be a mere pivotal connection such as a hinge or a pin passing through bores in each rigid member but preferably the connecting means does not just allow pivotal movement of the rigid members. If movement in other directions is allowed the sling will be more comfortable for all disabled people using the sling. A suitable connection is therefore to include a slot at one end of each rigid member remote from the curvate surface. A piece of strong webbing is thread through both slots and then its ends attached to each other. This allows the rigid members to move slightly apart if a slightly larger person is to use the sling and still allows the pivotal movement of the rigid members. The strength of webbing such as that used in seat belts is now well known and will be apparent to a man skilled in this field.

Since the edge of the rigid member remote from the center connecting means has to be slipped under the thigh of a disabled person it is preferred that this edge is as thin as possible. However, it matters not whether the rest of the rigid member is itself thick or thin. However, it is preferred that the rigid member is of a thin material. This may be a metal such as aluminum or stainless steel but is preferably plastic. The plastic plates may be produced which are planar which can then merely be heat molded at one edge to form the correct curve for a particular size of a disabled person. If the rigid member is made from metal such as aluminum or stainless steel it will be cold in contact with the patient's thigh. It is therefore preferred that a sleeve is provided of a padded or thick material which can be slipped over each rigid member to make the sling more comfortable for use by a disabled person. Typically the sleeve may be made of real or synthetic sheepskin which is not only comfortable but is also a warm material.

Although the structure of the sling supporting the underside and one side of each thigh only support the thighs very safely there are some cases in which a disabled person may not feel secure since they are used to being held by slings which have straps supporting each side of the thigh. In this case it is preferred that the sling includes at the edge of each rigid member remote from the center connecting means, means for detachably fastening a leg support strap to it. The leg support strap is then passed over the thigh and attached to the lifting device which give the disabled person more security. The straps do not have to be very strong because they will not have to take the weight of the patient. They are merely there to give the disabled person an added feeling of security. The means for securing the support strap to the edge of the sling may comprise a slot at the edge of each rigid member through which the support strap may be passed to form a loop with the strap then being fastened together to form a loop to hold the strap in position. However, to save time in using the sling the strap may be attached to the rigid member by a conventional press-stud fastening.

BRIEF DESCRIPTION OF THE DRAWINGS

Three examples of slings for lifting the thighs of disabled people in accordance with the invention will now be described, by way of example only, with reference to the accompanying drawings, in which.

DESCRIPTION OF THE PREFERRED EMBODIMENT

Figure 1:
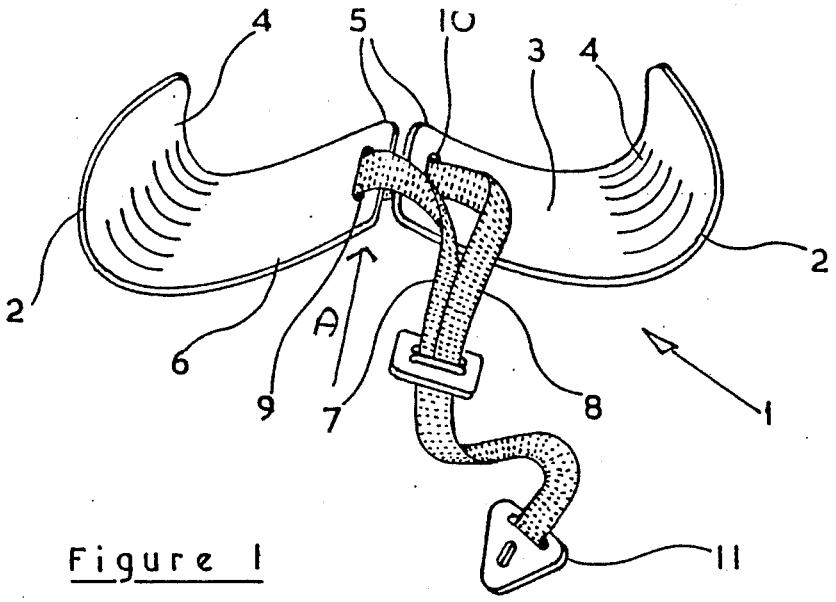
FIG. 1 is a perspective view of a first example of a sling.

A first sling 1 is shown in perspective in FIG. 1. It comprises two identical rigid members 2. Each rigid member 2 is made of a rigid molded plastics material and is of constant cross section when taken along a first longitudinal direction generally indicated by the arrow 'A'.

Each rigid member 2 includes an inner surface 3 which, in use, will be closest to the disabled person. The inner surface 3 includes a curvate portion 4. This arcuate portion 4 curves around a number of axes all parallel to the longitudinal direction. In some cases the curvate portion 4 may be a simple curve of one radius about one axis but in most cases the curve is a compound curve about a number of axes. However, all these axes are parallel to one another and parallel to the longitudinal direction. The rigid members 2, therefore, have a J-shape or hook-shape when viewed from the edge in side elevation or in longitudinal cross section.

In this case the rigid member 2 is made of a thin plastics material such that not only does the inner surface 3 describe the curve 4 but the whole curvate portion 4 describes this curve. At the other end 5 of the rigid member 2 is a substantially planar portion 6.

A connecting member 7 comprising a length of webbing 8 is passed through slots 9 and 10 at the end of each of the rigid members 2. This connecting means allows pivotal movement of the rigid members 2 relative to one another about an axis generally parallel to the axes about which the curve 4 curves. The connecting means comprises a piece of webbing 8 which passes through slots 9 and 10 at the end 5 remote from the curvate portion 4. This allows the members 2 to move slightly apart from one another which gives greater flexibility for the user. The ends of webbing 8 are coupled together and connected to means 11 for attachment to a lifting device. The means 11 for attachment for the lifting device will not be described in detail since there are many different types of attachment available and they will be well known to a skilled addressee of the specification.

Figure 2A:
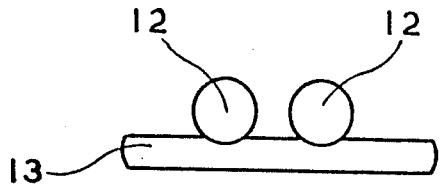
FIG. 2A, 2B, 2C and 2D show schematic sections through the first example of the sling in use during the stages of lifting a disabled person.
Figure 2B:
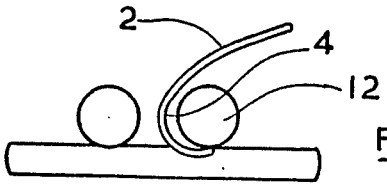
Figure 2C:
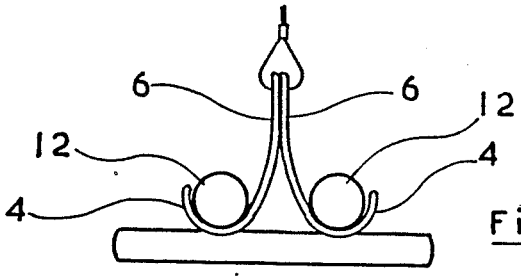

The way of using the sling shown in FIG. 1 is shown in detail in FIGS. 2A to 2D. This sling is used with the inner surface 3 uppermost. In FIGS. 2A to 2D the thigh of the disabled person are indicated as circles 12 to simplify the drawings. The surface on which the thighs are supported is indicated generally as 13. The first step of using the sling is to place one edge 4 of a first member 2 under the inside of the first leg 12 and slide the curvate edge 4 until it is in a position as shown in FIG. 2C. A similar movement is carried out with the other rigid member and the second leg. The webbing connection allows for easy maneuvering of the rigid members 2 relative to one another. As can be seen in FIG. 2 when the weight of the disabled person is not applied on the sling the planar portions 6 of the rigid members lie next to each other and the curvate portions 4 could not be said to be gripping the legs 12.

Figure 2D:
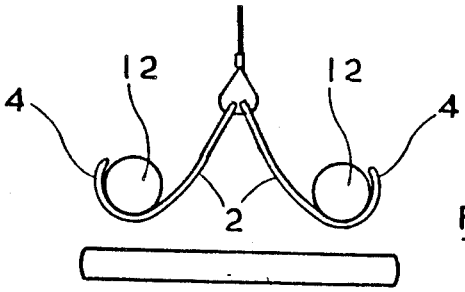

However, as is shown in FIG. 2D once the weight of the disabled person is applied to the sling the thighs 12 tend to separate and rotate the members 2 relative to one another to allow the curvate portions 4 of the inner surface to grip the thighs 12 to hold the disabled person securely. In this way, the disabled person can be lifted very easily from a flat surface 13 without difficult maneuvering.

Figure 3:
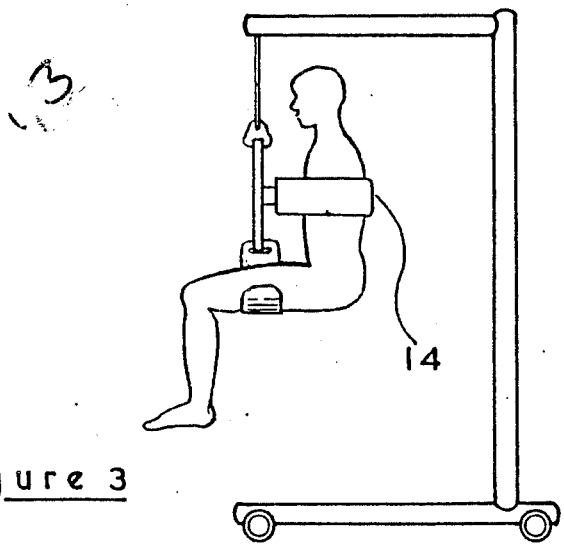
FIG. 3 is a schematic elevation of the sling of FIG. 1 in use.

As can be shown in FIG. 3 schematically if necessary an auxiliary sling 14 may then be used to support the back of a patient if this is necessary.

Figure 4:
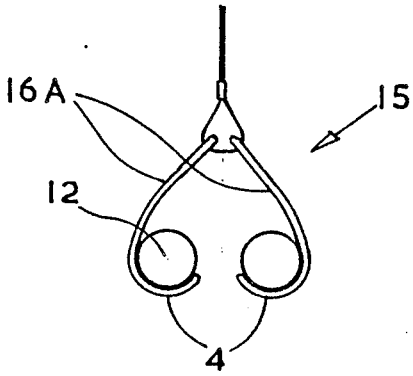
FIG. 4 is a schematic view of a second example of a sling in use.
Figure 5:
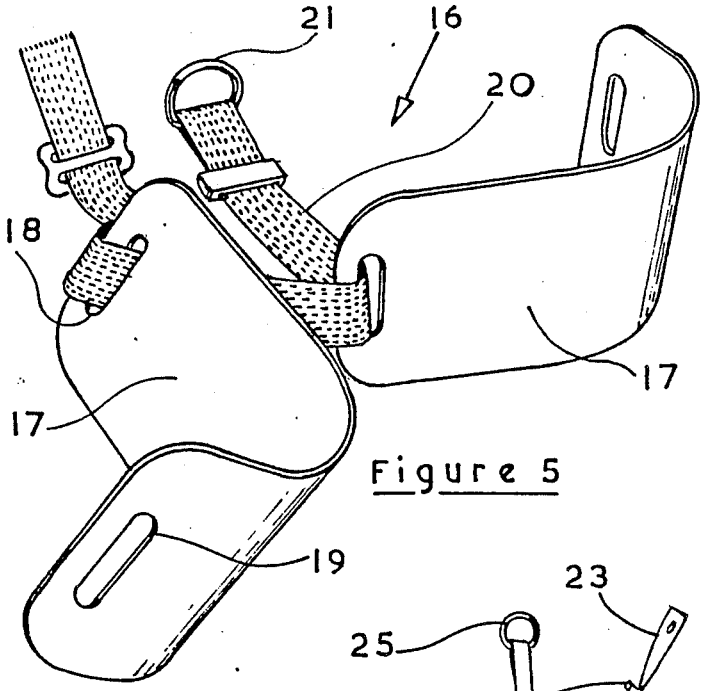
FIG. 5 is a perspective view of the rigid members of a third example of a sling.
Figure 7:
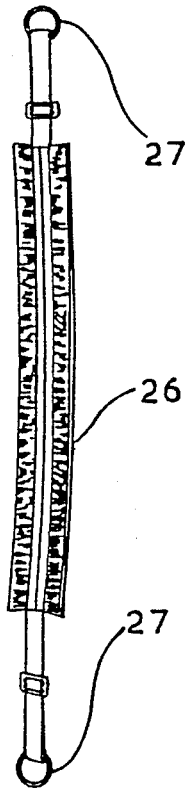
FIG. 7 is a view of a back support strap for use with the third example of the sling.

The only problem with the sling described is that it can be very difficult for a disabled lady to use when wearing a skirt. The sling of FIG. 4 which is the second example solves this problem. The second sling 15 is made up of two rigid members 16A which are identical to the rigid members 2 of the first example. The only difference in their use is that the connecting means couples the two members 16 together such that their inner surface 3 faces generally downwards. As can be seen in FIG. 4 there is now no need for any part of the sling to pass between the legs of the disabled person thus allowing them to wear a skirt. In the case of the second example of the disabled person applied on the connecting means tends to rotate the members 16 inwards towards one another to grip the legs by the curvate portions 4.

Since the same members 2 can be used to produce both forms of sling this forms a very simple and effective production method for making both slings. Thus, both slings can be made very cheaply and easily which will provide an inexpensive sling lift for any disabled person.

Figure 8:
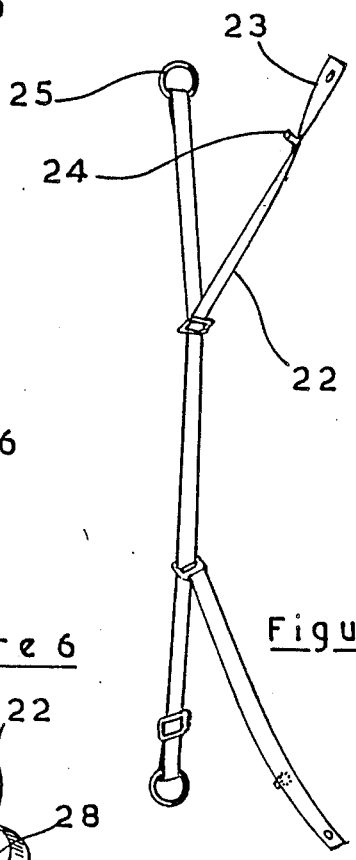
FIG. 8 is a perspective view of a leg support strap for use with the third example of the sling.
Figure 6:
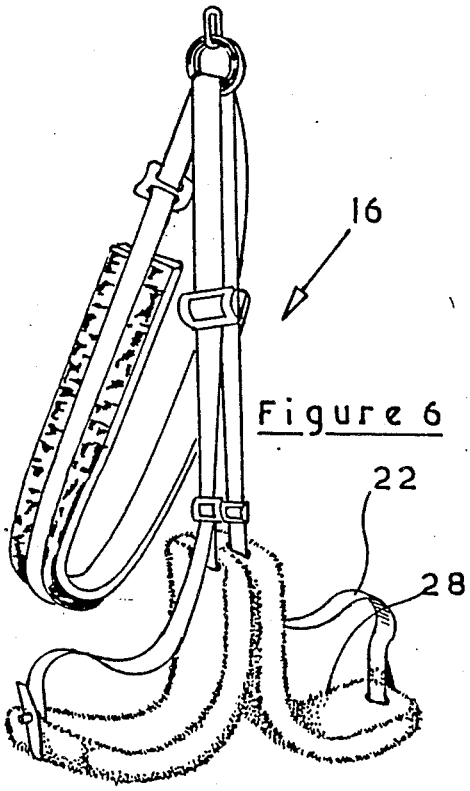
FIG. 6 is a perspective view of the third example of the sling.

A third example of a sling is very similar to the first example of a sling. The third sling 16 comprises two identical rigid members 17. The structure of the rigid members 17 is very similar to the rigid members 2 except for the fact that the rigid members 17 are made from stainless steel instead of molded plastics. The stainless steel used is DP1301 which is tested to a strength of 200 kilograms. The basic shape of the rigid members 17 is the same as rigid members 2 of the first sling but the rigid members 17 includes two slots 18 and 19. The first slot 18 has the same purpose as the slots 9 and 10 of the rigid members 2 which allows webbing 20 to be threaded through them to form the connecting members and which lead to a D-ring 21 to allow attachment to a lifting device. The slot 19, however, is used to help attachment of leg support strap 22 shown in FIG. 8. The purpose of the leg support straps 22 are merely to give the disabled person lifted by the sling a feeling of security. The support straps need only be made of a thinner webbing than webbing 20 since it is not going to have to have a great deal of strength. The leg support straps 22 have their ends 23 passed through the slot 19 and then looped over together and attached to each other by stud fastener 24 to hold the leg strap 22 in position. The leg strap 22 is then coupled to a lifting device via D-ring 25 as shown in FIG. 6.

Also required is back support strap 26 and D-ring 27 to couple it to the lifting device. The back strap 26 is padded and is just passed about the back of the disabled person to support their back comfortably.

The sling 16 also includes a pair of sleeves 28. The sleeves 28 are made of sheepskin material and their purpose is to make the sling more comfortable for the disabled person being lifted by it.

An alternative form of fastening means for the leg strap 22 comprises a stud fastener which projects from the underside of each rigid member 17, and which, in use, engages a corresponding fastener on the strap 22. In this case, the slots 19 are not present so that, when attached to the rigid member 17, the strap 22 passes over the curvate end of the rigid member 17.

Back support straps of various widths may be used, and the wider straps (typically around 12" wide) may include battens to increase rigidity.

I claim:

1. A sling for lifting the thighs of a disabled person comprising two rigid members substantially identical to one another;

each rigid member having a cross section in a first longitudinal direction which is substantially constant and of a J-shape, each J-shaped rigid member having an elongated portion with an arcuate portion at one end and connection means at the other end, said arcuate portion having sufficient curvature to a point opposite said elongated portion to hook around the thigh of a person supported therein a distance sufficient to prevent the thigh from slipping sidewise out of the sling, supporting means connecting said connection means closely together at said other end of said rigid members to form a single lifting point allowing pivotal movement of said rigid members relative to each other whereby the weight of the person being lifted maintains said arcuate portions hooked around and gripping the thighs of the person during lifting, said sling supporting means including means for attaching the sling at said single lifting point to a lifting device in the region of said connection means.

2. A sling according to claim 1 in which said supporting means and means for attaching the sling to the lifting device are arranged such that in use the elongated portions of the rigid members extend upward between the legs of the disabled person supported thereon and said arcuate portions extending outward and hooked under and around the thighs of such person.

3. A sling according to claim 1 in which said supporting means and means for attaching the sling to the lifting device are arranged such that in use the elongated portions of said rigid members extend upward outside the legs of the disabled person supported thereon with the arcuate portions extending inward and hooked around the outside and underneath and inside the thighs of such person.

4. A sling according to claim 1 in which said supporting means provides both a pivotal connection and allows translational movement of the rigid members with respect to each other.

5. A sling according to claim 2 in which said supporting means provides both a pivotal connection and allows translational movement of the rigid members with respect to each other.

6. A sling according to claim 3 in which said supporting means provides both a pivotal connection and allows translational movement of the rigid members with respect to each other.

7. A sling according to claim 4 in which
each rigid member connection means comprises a slot in said elongated portion other end, said supporting means comprising a elongate length of strong webbing which is passed through both slots with its ends attached to each other.

8. A sling according to claim 5 in which
each rigid member connection means comprises a slot in said elongated portion other end, said supporting means comprising a elongate length of strong webbing which is passed through both slots with its ends attached to each other.

9. A sling according to claim 6 in which
each rigid member connection means comprises a slot in said elongated portion other end, said supporting means comprising a elongate length of strong webbing which is passed through both slots with its ends attached to each other.

10. A sling according to claim 1 in which
each rigid member elongated portion is of a thin planar material.

11. A sling according to claim 2 in which
each rigid member elongated portion is of a thin planar material.

12. A sling according to claim 3 in which
each rigid member elongated portion is of a thin planar material.

13. A sling according to claim 4 in which
each rigid member elongated portion is of a thin planar material.

14. A sling according to claim 1 in which
said rigid member is made of aluminum, stainless steel or plastic.

15. A sling according to claim 2 in which
said rigid member is made of aluminum, stainless steel or plastic.

16. A sling according to claim 3 in which
said rigid member is made of aluminum, stainless steel or plastic.

17. A sling according to claim 4 in which
said rigid member is made of aluminum, stainless steel or plastic.

18. A sling according to claim 1 including
a leg support strap detachably connected between the edge of the arcuate portion of each rigid member and said connection means for attaching the sling to a lifting device.

19. A sling according to claim 1 which includes
a sleeve of padded or thick material on each rigid member.

20. A sling according to claim 1 including
a leg support strap detachably connected between the edge of the arcuate portion of each rigid member and said connection means for attaching the sling to a lifting device, and
a sleeve of padded or thick material on each rigid member.

* * * * *